US007556296B2

(12) United States Patent
Kondo et al.

(10) Patent No.: US 7,556,296 B2
(45) Date of Patent: Jul. 7, 2009

(54) VEHICLE DOOR HANDLE AND VEHICLE DOOR HANDLE MANUFACTURING METHOD

(75) Inventors: Hideyuki Kondo, Inazawa (JP); Hiroshi Muraki, Inazawa (JP)

(73) Assignee: Sakaeriken Kogyo Co., Ltd., Inazawa (JP)

( * ) Notice: Subject to any disclaimer, the term of this patent is extended or adjusted under 35 U.S.C. 154(b) by 20 days.

(21) Appl. No.: 11/483,153

(22) Filed: Jul. 10, 2006

(65) Prior Publication Data

US 2007/0138812 A1 Jun. 21, 2007

(30) Foreign Application Priority Data

Dec. 19, 2005 (JP) ..... 2005-365196

(51) Int. Cl.
*E05C 3/00* (2006.01)
*E05B 1/00* (2006.01)

(52) U.S. Cl. ..... 292/336.3; 292/DIG. 38; 292/DIG. 73

(58) Field of Classification Search ..... 292/336.3, 292/DIG. 31, DIG. 53, DIG. 38, DIG. 73
See application file for complete search history.

(56) References Cited

U.S. PATENT DOCUMENTS 4,813,724 A * 3/1989 Dietrich ..... 292/341.12
5,887,918 A * 3/1999 Okada et al. ..... 292/336.3
6,523,871 B1 * 2/2003 Josserand ..... 292/347
6,543,090 B2 * 4/2003 Muneta ..... 16/412
6,594,861 B2 * 7/2003 Dimig et al. ..... 16/412
6,672,633 B2 1/2004 Nomura et al.
6,749,236 B2 * 6/2004 Nomura et al. ..... 292/336.3
6,880,870 B2 * 4/2005 Costigan ..... 292/336.3
7,011,349 B2 * 3/2006 Nomura et al. ..... 292/347
2003/0038486 A1 2/2003 Nomura et al.

FOREIGN PATENT DOCUMENTS

| | | |
|---|---|---|
| DE | 4415158 | * 11/1995 |
| FR | 2846691 | * 5/2004 |
| JP | 2003-41811 | 2/2003 |

* cited by examiner

*Primary Examiner*—Carlos Lugo
(74) *Attorney, Agent, or Firm*—Oliff & Berridge, PLC

(57) ABSTRACT

A vehicle door handle includes a handle main body and a base member for attaching the handle main body to the vehicle door. The handle main body is lever-shaped, and is supported by the base member to be rotatable in a predetermined range, the handle main body having one of both ends serving as a spindle and the other end serving as a free end, a hook protruding toward the base member in a longitudinal direction of the handle main body formed on the free end of the handle main body. A stopper abutting on the base member formed on a tip end of the hook, and guide walls adjacent to both side surfaces of the stopper, are formed on the base member.

8 Claims, 8 Drawing Sheets

Enlarged perspective view of important parts of base member

Enlarged perspective view of important parts of base member

Cross-sectional view of vehicle door handle taken along line B-B

Cross-sectional view of vehicle door handle taken along line A-A

Cross-sectional view of vehicle door handle taken along line X-X

PRIOR ART

VEHICLE DOOR HANDLE AND VEHICLE DOOR HANDLE MANUFACTURING METHOD

RELATED APPLICATIONS

This application claims the priorities of Japanese Patent Application No. 2005-365196 filed on Dec. 19, 2005, which is incorporated herein by reference.

BACKGROUND OF THE INVENTION

1. Field of the Invention

The present invention relates to a vehicle door handle and a vehicle door handle manufacturing method.

2. Description of the Related Art

A vehicle door is equipped with a vehicle door handle of an arbitrary one of various types so as to open and close the vehicle door. For instance, there is known a vehicle door handle configured as follows. If a user grips a grip handle main body and pulls the handle main body toward the user when opening the door, then a door lock mechanism of the door is released. If the user further pulls the handle main body toward the user in that released state, the user can open the door.

Patent Literature 1: Japanese Patent Application Laid-Open No. 2003-041811

Specifically, the vehicle door handle that includes the grip handle main body as disclosed in the Patent Literature 1 is configured by assembling together, for example, a lever-shaped handle main body (grip outer handle), a base member (frame), an elastic member (a coil spring), and a bell crank (handle lever). The lever-shaped handle main body (grip outer handle) is arranged at a predetermined position of the vehicle door and operated when the door is opened or closed. The base member (frame) is a member for attaching the handle main body to a door outer panel or the like. The elastic member (coil spring) consists of a torsion spring or the like that urges the handle main body in a direction of returning the main body into an original state when the handle main body is operated. The bell crank (handle lever), with which one end of the elastic member is engaged, is linked to a door lock mechanism.

Further, the handle main body includes a rotation support formed on one end of the handle main body and an engagement portion formed on the other end thereof. The rotation support serves as a spindle and rotatably fixes the handle main body. The engagement portion includes a hook protruding upright in a longitudinal direction of the handle main body and a stopper located on a tip end of the hook. The base member 103 includes a fixing portion that rotatably fixes the rotation support, stopper engagement portions 107, and guide walls 108 to correspond to the both ends of the handle main body, respectively. As shown in FIG. 7A, the stopper engagement portions 107, with which the stopper is engaged, restrict the handle main body to be rotatable within a rotation range. The guide walls 108 are formed on both sides of the stopper, respectively, and guide a rotation operation of the handle main body.

Meanwhile, such a base member 103 is formed integrally out of, for example, a plastic material. In forming the base member 103, a separable mold including, for example, a fixed mold part, a movable mold part, and the like is sometimes used. FIG. 7B is a cross-sectional view of the base member 103 taken along a line X-X of FIG. 7A. As shown in FIG. 7B, inner wall surfaces 108*a* of the respective guide walls 108 facing each other are formed to be inclined in a direction in which a distance between the inner wall surfaces 108*a* is widened from a rear anchor end (the stopper engagement portion 107 side) toward a tip end of the base member 103. To do so, it is necessary to set a draft for relatively separating the movable mold part from the fixed mold part in an arrow "Y" direction when the base member 103 is to be one-piece molded with plastics. Accordingly, a gradient "t" for the draft is formed.

FIGS. 8A to 8C are explanatory views of states in which the conventional vehicle door handle is used, respectively, and correspond to the X-X cross-section shown in FIG. 7B. F*ig*. 8A shows a state in which the handle main body is not operated (a non-operated position). FIG. 8B shows a state in which the handle main body is operated (an operated position). As shown in FIG. 8A, the handle main body 101 is always held and urged by the elastic member in a direction of approaching the vehicle door. A gap corresponding to the gradient "t" is formed between the inner wall surface 108*a* of each guide wall 108 and each side surface 106*a* of the stopper 106 since dimensions are set according to the rear anchor end of each guide wall 108. As shown in FIG. 8B, if the handle main body 102 is pulled toward a position at which the stopper 106 is engaged with the stopper engagement portions 107 against an urging force of the elastic member, the door lock mechanism of the door is released. In this released state, when the handle main body 102 is pulled toward the user, the door can be opened However, the conventional vehicle door handle has the following disadvantages. F*ig*. 8C shows a state in which the handle main body 102 is operated to be pulled to a maximum state, and in which the stopper 106 is engaged with the respective stopper engagement portions 107. In this state, the handle main body 102 is restricted by the respective stopper engagement portions 107 only such that the both side surfaces 106*a* of the stopper 106 are adjacent to the inner wall surfaces 108*a* of the respective guide walls 108 with slight gaps formed therebetween, and such that outer side surfaces 105*a* of the hook 105 are adjacent to the inner side surfaces 107*a* of the respective stopper engagement portions 107 with slight gaps formed therebetween. As a result, if the stopper 106 is inclined according to the gradient "t", a grip of the handle main body 102 is vertically moved by as much as a displacement "T" to be proportional with a length of the hook 105. Namely, a rattle corresponding to the displacement "T" occurs, thereby deteriorating a feel of the handle main body 102 (grip) when the user grips the handle main body 102. Further, in FIG. 8A, a gap (a play) is generated between the stopper 106 and a tip end of each guide wall 108. Due to this, if the user grips the handle main body 102 and applies a vertical force to the handle main body 102, a rattle occurs, thereby deteriorating the feel of the handle main body 102.

Moreover, the guide walls 108 are formed to be relatively thin Due to this, with the passage of time, a deformation occurs to the guide walls 108 in a thickness direction For example, the guide walls 108 facing each other fall down either outward or inward. If the guide walls 108 fall down outward, the gaps between the guide walls 108 and the stopper 106 are wider. As a result, a degree of the rattle is higher. If the guide walls 108 fall down inward, an operativity for pressurizing the stopper 106 slidably moved between the guide walls 108 is deteriorated.

SUMMARY OF THE INVENTION

It is an object of the present invention to provide a vehicle door handle capable of reducing a rattle that occurs in a vertical direction when a user operates a handle main body, and capable of ensuring an excellent feel and an excellent stability.

According to a first aspect of the present invention, there is provided a vehicle door handle comprising:

a handle main body arranged at a predetermined position of an exterior of a vehicle door, and operated when the door is opened or closed; and a base member for attaching the handle main body to the vehicle door, wherein the handle main body is lever-shaped, and is supported by the base member to be rotatable in a predetermined range, the handle main body having one of both ends serving as a spindle and the other end serving as a free end, a hook protruding toward the base member in a longitudinal direction of the handle main body is formed on the free end of the handle main body, and a stopper abutting on the base member and restricting a rotation range of the handle main body is formed on a tip end of the hook, thereby setting an operated position and a non-operated position of the handle main body, and insertion holes that the hook and the stopper of the handle main body are inserted into, a pair of guide walls adjacent to both side surfaces of the stopper, respectively, at the non-operated position of the handle main body, protruding from opening edges of the insertion holes, and having inner surfaces facing each other approximately parallel to each other, and a stopper engagement portion capable of locking the handle main body at the operated position positioned by being rotated from the base member, so as not to allow any further rotation, are formed on the base member, wherein each of the guide walls is arranged to face each side of each of the hook and the stopper, and a connection portion is formed on tip ends of the guide walls at a position allowing space formed from a tip surface of the stopper of the handle main body positioned at the non-operated position, and also a position allowing no overlap with the stopper engagement portion from an axis direction of the insertion holes are formed on the base member.

According to the first aspect of the present invention, at the non-operated position of the handle main body, the guide walls are formed to be adjacent to the respective both side surfaces of the stopper. In other words, no gap is formed between each guide wall and the side surface of the stopper. Due to this, even if a user grips the handle main body and applies a verticle force thereto, the stopper abuts on the guide walls to restrict a displacement of the handle main body. Therefore, it is possible to suppress a verticle movement of the handle main body, that is, suppress occurrence of a rattle to the handle main body, and enhance a feel of the handle main body when the user grips the handle main body.

Further, in the vehicle door handle according to the first aspect of the present invention, each of the guide walls can be arranged to face each side of each of the hook and the stopper, and a connection portion can be formed on tip ends of the guide walls. Normally, the guide walls are formed to be relatively thin. Owing to this, a deformation, e.g., falling down outward or inward, tends to occur to the guide walls in a thickness direction. However, the guide walls according to the present invention are reinforced by connecting their tip ends to the connection portion. This can suppress the deformation of the guide walls in the thickness direction and ensure excellent durability. In addition, the stopper of the handle main body can be stably guided by the guide walls. Further, since the stopper is stabilized, occurrence of the rattle to the handle main body can be suppressed, whereby the feel of the handle main body can be enhanced when the user grips the handle main body. Besides, since the connection portion is provided on the tip ends of the respective guide walls, a sufficient space can be given to the peripheral portions of the guide walls. Due to this, an assembly operation can be performed when the handle main body is attached to the base member without need of special steps or dedicated tools. It is thereby possible to suppress an unnecessary increase in manufacturing cost.

Moreover, in the vehicle door handle according to the first aspect of the present invention, the guide walls can be formed so that inner surfaces facing each other are approximately parallel to each other. By doing so, the guide walls are formed approximately parallel to each other, that is, the guide walls are not inclined so that the distance between the guide walls is widened, for example, from a rear anchor end to a tip end of each guide wall. Due to this, if the vehicle door handle is formed while setting a width of the stopper and the distance between the guide walls to be substantially equal (so that the side surfaces of the stopper and the inner wall surfaces of the guide walls are slidable with respect to one another while abutting one another), the side surfaces of the stopper and the inner wall surfaces of the guide walls can always abut one another between the non-operated position and the operated position. Accordingly no gaps are formed between the side surfaces and the inner wall surfaces. It is thereby possible to suppress occurrence of a run-out or a rattle during operation of the vehicle handle, stably perform a handle operation, and enhance a feel of the vehicle door handle.

Additionally, in the vehicle door handle according to the first aspect of the present invention, if a thickness of the stopper adjacent to the guide walls is d and a length of the hook is D, d/D falls within a range represented by $d/D \geqq 0.14$.By doing so, a length of the side surface of the stopper is increased. Therefore, an area of the side surface that abuts on the inner wall surface of each guide wall can be enlarged, and degree of the rattle can be reduced even in a state in which the handle main body is operated to be pulled to the maximum state. Accordingly, it is possible to provide the vehicle door handle having an excellent feel.

According to the second aspect of the present invention, there is provided a method for manufacturing a vehicle door handle according to the first aspect of the present invention, wherein in a separable mold having a cavity corresponding to a shape of the base member, a direction of slidably pulling a mold part that forms an inside of each of the guide walls is approximately perpendicular to a rotation direction of the handle main body in the corresponding guide wall.

According to the second aspect of the present invention, despite a simple structure of adding only a mold part for which the direction of pulling the mold part that forms the inside of each guide wall is set to the direction perpendicular to the rotation direction of the handle main body, the vehicle door handle having the above-stated advantages can be easily manufactured while suppressing an increase in the manufacturing cost.

DESCRIPTION OF THE PREFERRED EMBODIMENT

Figure 1:
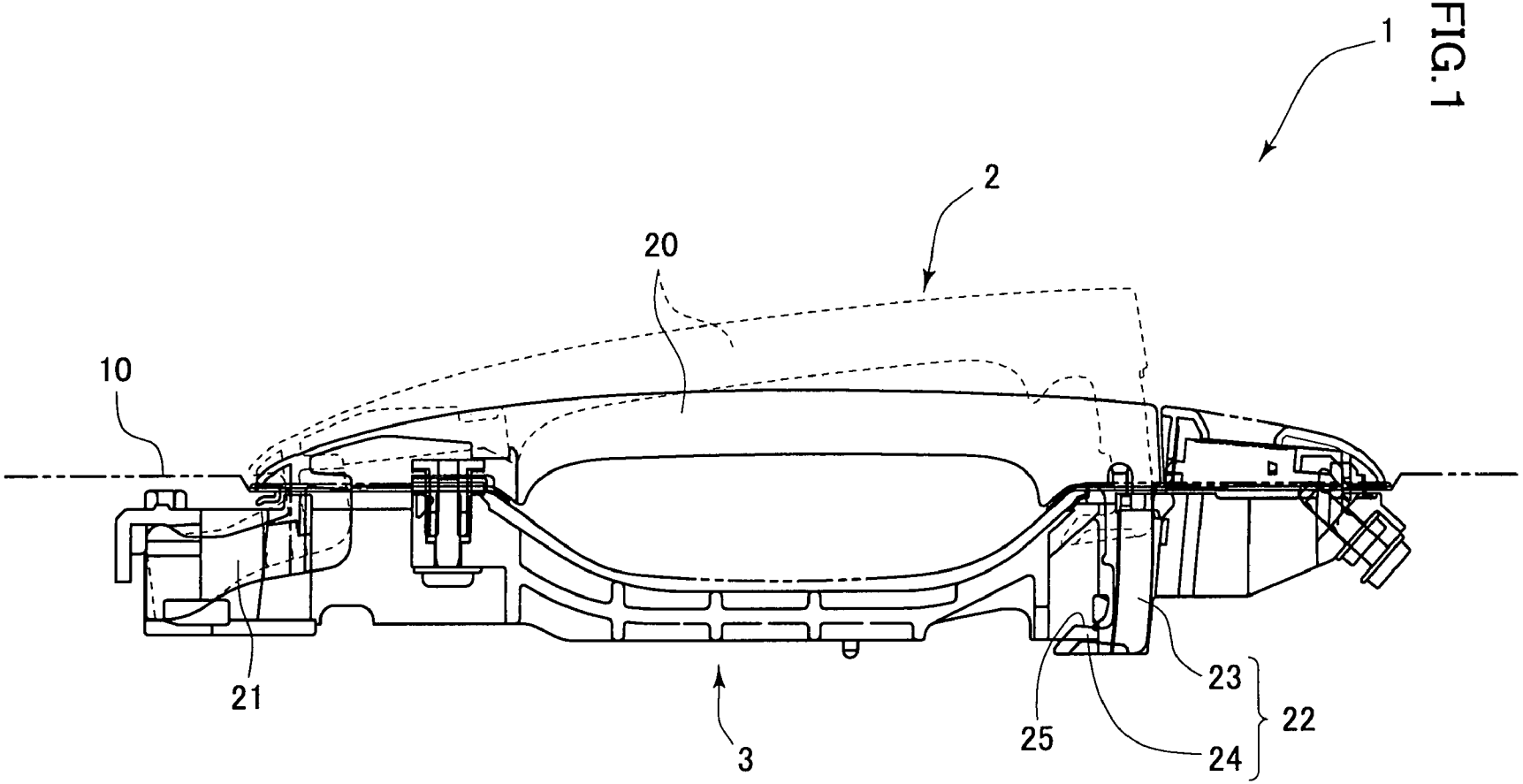
FIG. 1 is a partial cross-sectional view of a vehicle door handle according to one embodiment of the present invention.
Figure 2:
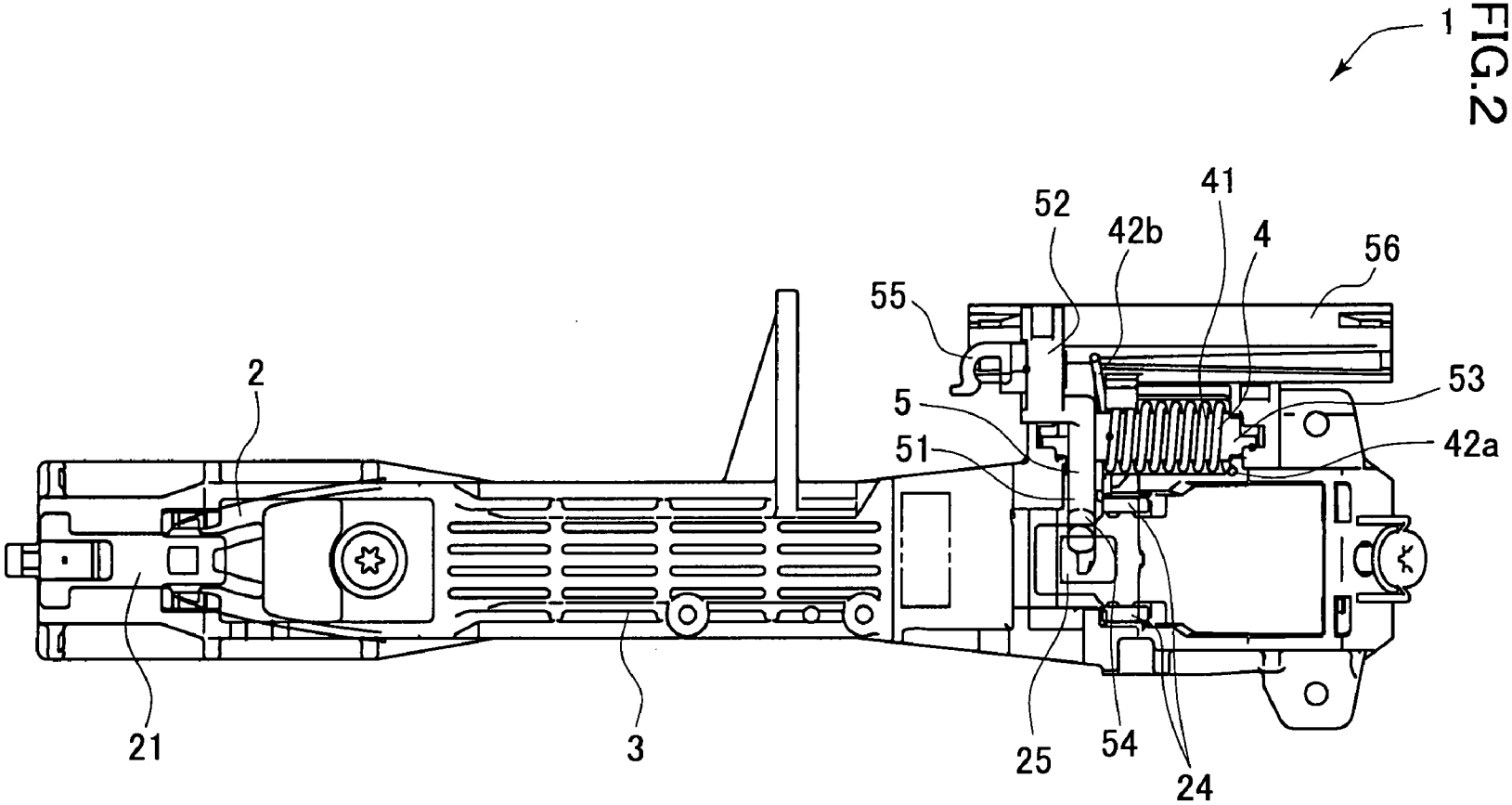
FIG. 2 is a bottom view of the vehicle door handle shown in FIG. 1.

An embodiment of the present invention will be described hereinafter with a reference to the accompanying drawings. In this embodiment, a vehicle door handle mainly used on a door of an automobile (a vehicle) will be explained. However, the present invention is not limited to the vehicle door handle. Various changes and modifications can be made of the invention within the scope of the invention as set forth in claims that follow based on knowledges of persons skilled in the art. FIG. 1 is a partial cross-sectional view of a vehicle door handle according to one embodiment of the present invention. FIG. 2 is a bottom view of the vehicle door handle shown in FIG. 1. A vehicle door handle 1 is arranged , for example, at a predetermined position of a vehicle door. as shown in FIGS. 1 and 2 , the vehicle door handle 1 includes a handle main body 2, a base member 3, an elastic member 4, and a bell crank 5. The handle main body 2 is operated when the vehicle door is opened and closed. The base member 3 is a member for attaching the handle main body 2 to a door outer panel 10 or the like. The elastic member 4 consists of a torsion spring or the like that urges the handle main body 2 into an original state when the handle main body 2 is operated. The bell crank 5, with which one end of the elastic member 4 is engaged, is linked to a door lock mechanism.

As shown in FIG. 1, the handle main body 2 includes a grip 20 in the form of a lever, a rotation support 21 provided on one end of the handle main body 2, and an engagement portion 22 provided on the other end thereof. The rotation support 21 serves as a spindle and rotatably fixes the handle main body 2. The engagement portion 22 includes a hook 23 and a stopper 24. The hook 23 protrudes upright in a longitudinal direction of the handle main body 2. The stopper 24, which is located on a tip end of the hook 23, protrudes in the form of a flange. An engagement surface 25, with which one end of the bell crank 5, to be described later, is always engaged, is formed in an upper portion of the stopper 24.

Figure 3A:
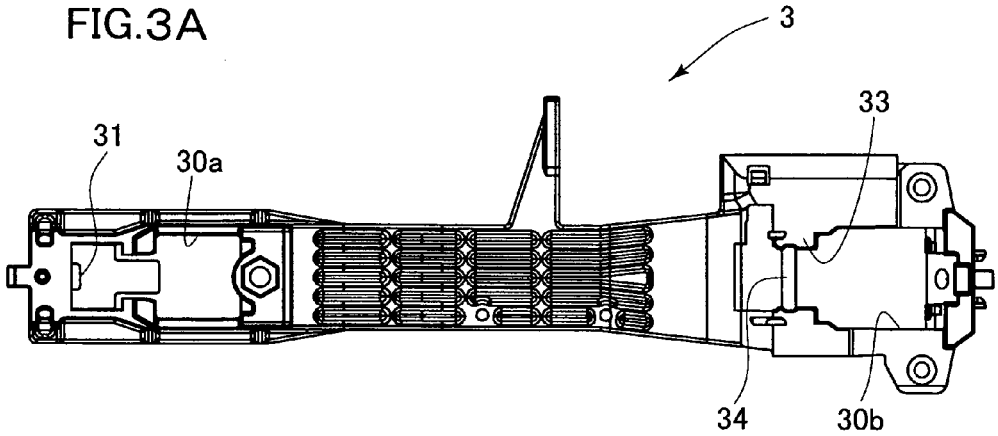
FIGS. 3A and 3B are a plan view of the base member and an enlarged perspective view of important parts of the base member, respectively
Figure 3B:
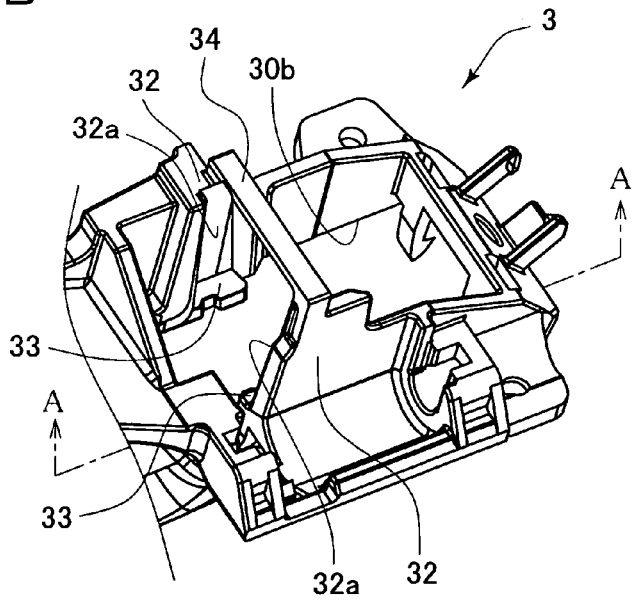
Figure 4A:
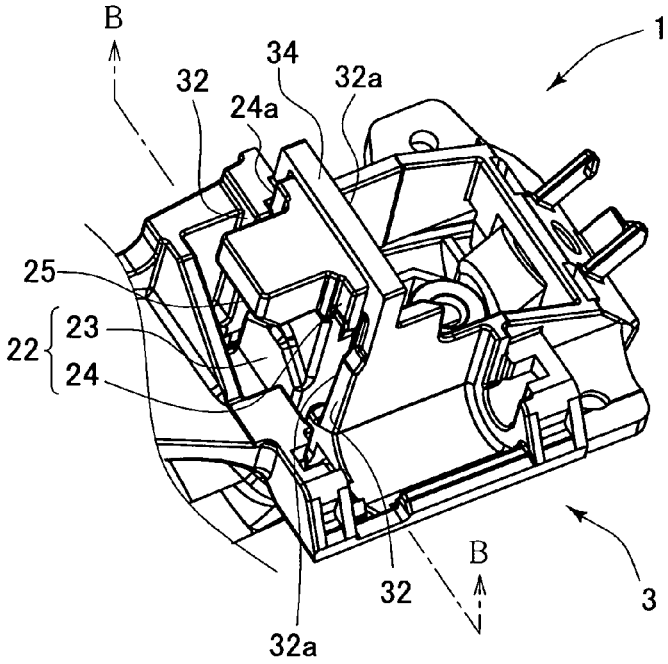
FIGS. 4A and 4B are an enlarged perspective view of important parts of the vehicle door handle taken along cross-sectional view of the vehicle door handle taken along a line B-B of FIG. 4A, respectively, for showing an assembled state of the vehicle door handle.
Figure 4B:
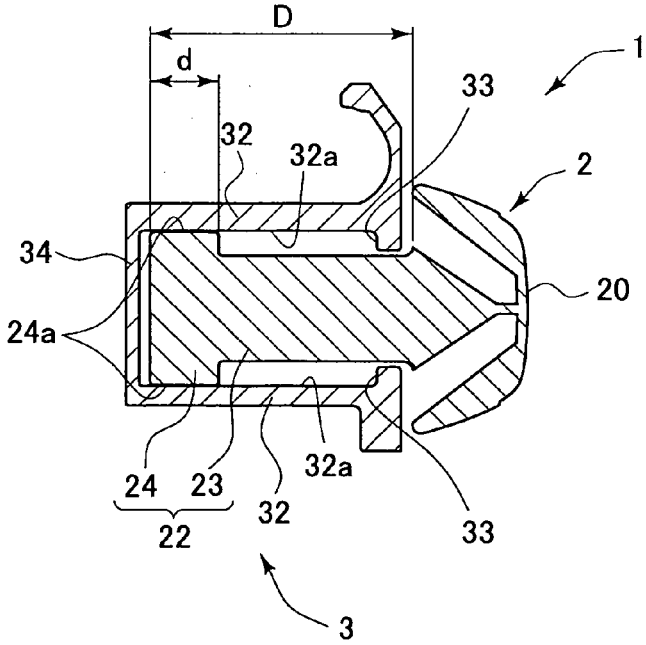

FIG. 3A is a plan view of the base member 3. FIG. 3B is an enlarged perspective view of the base member 3, showing important parts of the base member 3. FIG. 4A is an enlarged perspective view of the vehicle door handle 1, showing important parts of the handle 1 in an assembled state ( at a non-operated position of the door main body 2) relative to FIG. 3B. FIG. 4B is a cross-sectional view of the vehicle door handle 1 taken along a line B-B of FIG. 4A. As shown in F*ig*. 3A, the base member 3 includes insertion holes 30*a* and 30*b*,which are formed on an upper surface thereof and into which the rotation support 21 and the engagement portion 22 are inserted, respectively, to correspond to the both ends of handle main body 2. A fixing portion 31 that rotatably fixes the rotation support 21 is formed near the insertion hole 30*a*. As shown in FIG. 3B, the base member 3 also includes two guide walls 32, two stopper engagement portions 33, and a connection portion 34. The two guide walls 32 face each other and stand upright in a depth (bottom) direction along an opening edge of the insertion hole 30*b*. The two stopper engagement portions 33, which are provided on rear anchor end of the respective guide walls 32, restrict a rotation range of the handle main body 2 by engaging the stopper 24 therewith. The connection portion 34, which is formed on tip ends of the respective guide walls 32, connects the two guide walls 32 facing each other.

As shown in FIG. 4B, inner wall surfaces 32*a*of the respective guide walls 32 are formed approximately parallel to each other. As shown in FIG. 4A, at the non-operated position of the handle main body 2, the inner wall surfaces 32*a* are connected to each other by the connection portion 34 in a portion downward ( upward in FIG. 4A) of a lower surface of the stopper 24. A cross-sectional shape of the connection portion 34 is not limited to a specific one. However, it is preferable that the connection portion 34 is formed to have a rectangular cross section and formed to face the stopper 24 on a plane, a configuration of a mold can be simplified. Further, as shown in FIG. 4B, if a thickness of the stopper 24 ( a length of a slide surface 24*a* of the stopper 24) and the hook 23 are preferably formed so as to satisfy a relationship that d/D is equal to or greater than 0.14. It is more preferable that d/D is equal to or greater than 0.28. By doing so, the side surface 24*a*is formed to be long. Therefore, an area of the side surface 24*a* that abuts on the inner wall surface 32*a* of each guide wall 32 can be enlarged. A distance between restriction points (e.g., a distance from the inner peripheral surface 33*a* of the stopper engagement portion 33 to the side surface 24*a* of the stopper 24) can be increased. Accordingly, a rattle of the handle main body 2 can be reduced. If the stopper 24 is thicker (the side surface 24*a* of the stopper 24 is longer), occurrence of the rattle can be more suppressed. However, it is preferable to appropriately adjust the thickness of the stopper 24 in view of the rotation range of the handle main body 2 (a length of the hook 23) and space restrictions of the handle main body 2 in relation to peripheral parts, e.g., in view of compression of the handle main body 2 against a door inner panel when the handle main body 2 is attached to the door outer panel 10.

Referring back to FIG. 2, the elastic member 4 is, for example, a torsion spring, and includes a coil 41 and a first leg 42*a* and a second leg 42*b* (hereinafter, sometimes simply referred to as "legs 42") extending from both ends of the coil 41, respectively. A shaft 53 of the bell crank 5 is penetrated into the coil 41 and this bell crank 5 is fixed to the base member 3, thereby holding the elastic member 4. The bell crank 5 includes a first arm 51, a second arm 52, and the shaft 53. The shaft 53 is formed to protrude perpendicularly from an intersecting position at which the two arms 51 and 52 intersect each other. As stated, the shaft 53 is penetrated into the coil 41 of the elastic member 4, thereby holding the elastic member 4. In addition, the two arms 51 and 52 of the bell crank 5 are fixed to be rotatable around the bell crank 5 (shaft 53).

The first leg 42*a* of the elastic member 4 is, for example, appropriately engaged with the base member 3 at a predetermined position, and the second leg 42*b* thereof is engaged with the second arm 52 of the bell crank 5. By doing so, the bell crank 5 is always urged by the elastic member 4. The first arm 51 of the bell crank 5 includes a contact surface 54 that is urged by an urging force of the elastic member 4 to always abut on the engagement surface 25 of the stopper 24. In addition, the second arm 52 is equipped with a rod connector 55 that connects a rod for locking and unlocking the door in an interlocked manner with the door lock mechanism (not shown), and a counterweight 56.

By thus configuring, at the non-operated position (state indicated by a solid line in FIG. 1) of the handle main body 2 of the vehicle door handle 1, the bell crank 5 is always urged by a spring force (an elastic force) of the elastic member 4 in a direction of pulling back the handle main body 2. Following this, the engagement surface 25 of the stopper 24 is urged by the contact surface 54 of the bell crank 5. Accordingly, the handle main body 2 is held by the base member 3 at the non-operated position, with the rotation support 21 set as a rotation center. If the handle main body 2 is operated, the bell crank 5 is rotated by an action of the engagement surface 25 of the stopper 24 against the spring force of the elastic member 4. In addition, the vehicle door is unlocked (the handle main body 2 is moved to an operated position indicated by an imaginary line shown in FIG. 1) in an interlocked manner with the door lock mechanism (not shown) connected to the second arm 52 of the bell crank 5. If the handle main body 2 is finished with an opening operation, then the stopper 24 is pushed back through the bell crank 5 by the spring force of the elastic member 4, and the handle main body 2 is returned to the original state (non-operated state). As can be seen, the door lock mechanism is actuated through the elastic member 4 and the bell crank 5 in the interlocked manner with the movement (operation) of the handle main body 2. In this embodiment, the operated position or state refers to a position at which or a state in which the handle main body 2 is pulled to a maximum and the stopper 24 is engaged with the stopper engagement portions 33 of the base member 3. The non-operated position or state refers to a position at which or a state in which the handle main body 2 is urged by the elastic member 4 and held while being as close to the base member 3 as possible.

Figure 5A:
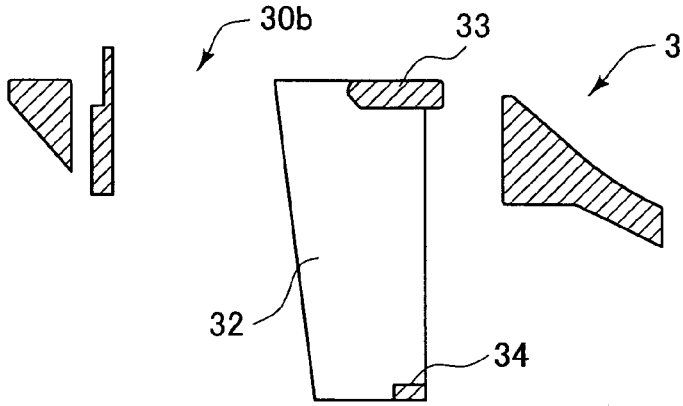
FIGS. 5A to 5C are explanatory views of a part of steps of forming the base member.
Figure 5B:
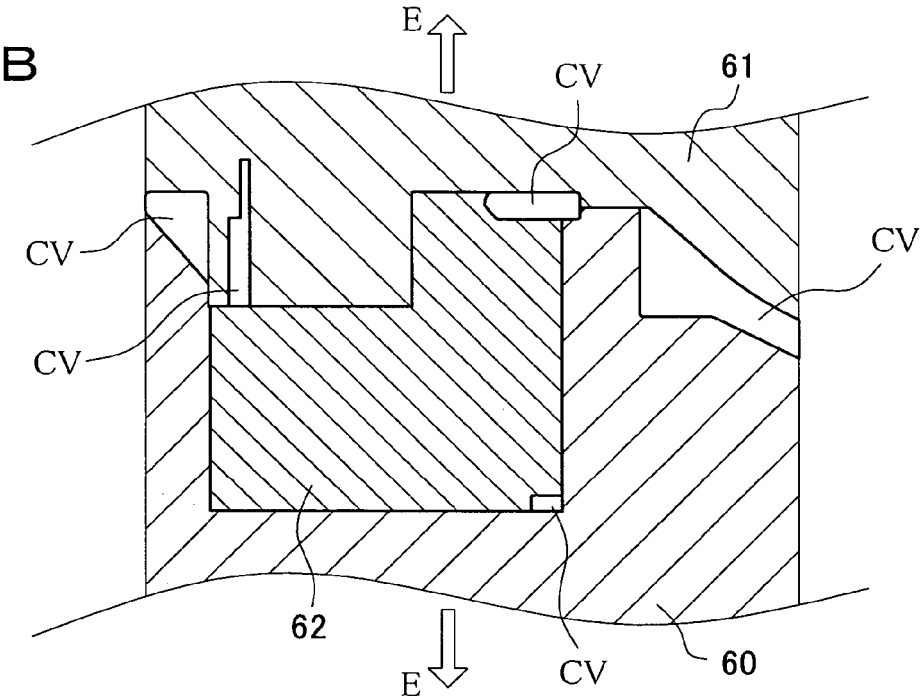
Figure 5C:
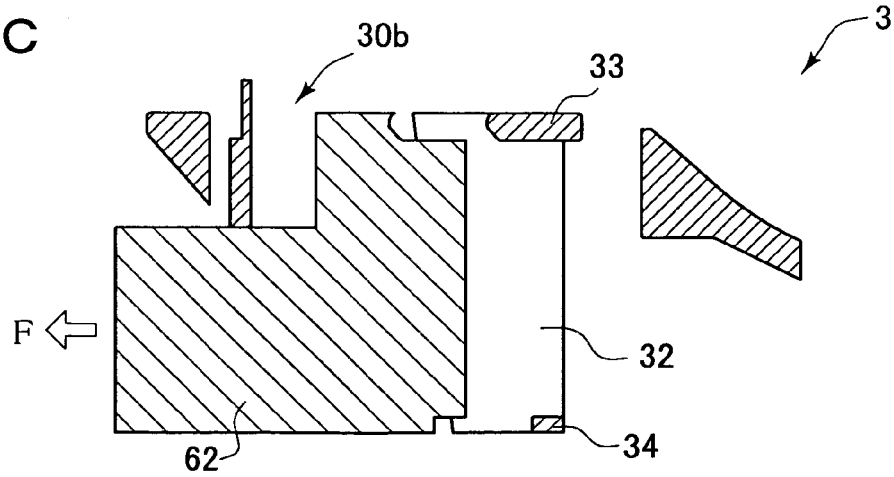

A part of steps of manufacturing the vehicle door handle 1 configured as stated above will next be described. FIGS. 5A to 5C are explanatory views of a part of steps of molding the base member 3. FIG. 5A is a cross-sectional view of the base member 3 taken along a line A-A of FIG. 3B. As shown in FIG. 5A, the guide wall 32, the stopper engagement portion 33, and the connection portion 34 are formed near the insertion hole 30*b*. The stopper engagement portion 33 and the connection portion 34 are constituted to be vertically superimposed on each other in FIG. 5A. FIG. 5B shows a step of arranging a mold. For example, a well-known injection mold that includes a fixed mold part 60, a movable mold part 61, and a slidable mold part 62 is arranged. A cavity CV corresponding to a shape of the base member 3 (near the insertion hole 30*b*) is formed in the mold. By introducing a molten resin or the like into this cavity CV and solidifying the molten resin, the base member 3 is molded. Next, the fixed mold part 60 and the movable mold part 61 are separated relative to each other in arrow E directions. Thereafter, as shown in FIG. 5C, the slidable mold part 62 is slidably moved relatively in a direction at a right angle with respect to a standing direction of the guide wall 32 (in an arrow F direction, i.e., a width direction), and pulled out from the base member 3. By doing so, draft of the guide wall 32 is set in the width direction. Therefore, the guide wall 32 can be formed perpendicularly (parallel) to a rotation direction of the handle main body 2. Alternatively, at this time, the slidable mold 62 can be used in a state in which the connection portion 34 is not provided. In this alternative, the guide walls 32 facing each other are parallel to the rotation direction of the handle main body 2. Due to this, even if the handle main body 2 is at the non-operated position, the side surface 24*a* of the stopper 24 and the tip end of the guide wall 32 can be set adjacent to each other. Hence, it is possible to provide the vehicle door handle 1 having an excellent feel and ensuring stability.

Figure 6A:
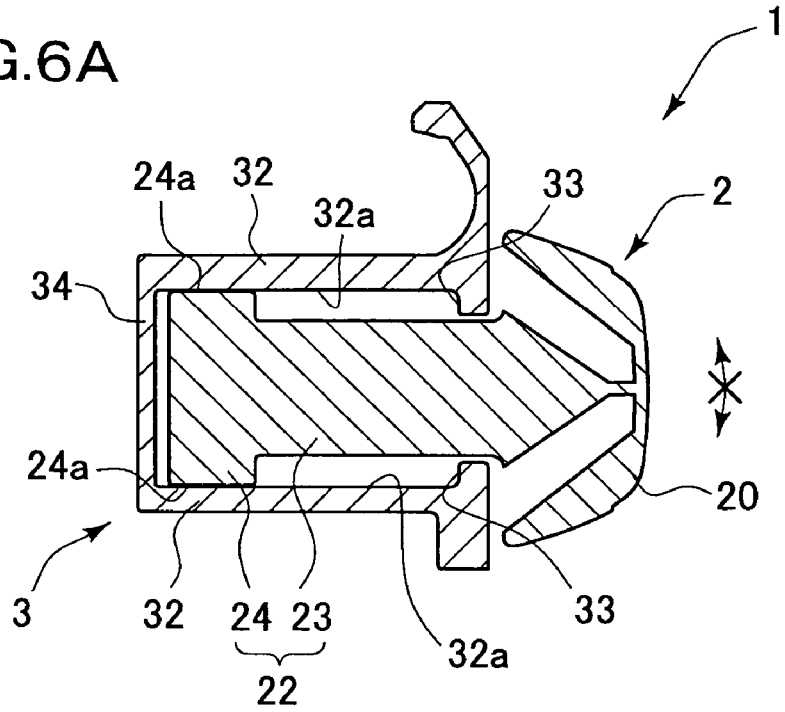
FIGS. 6A and 6B are explanatory views of states in which the vehicle door handle according to the present invention is used, respectively.
Figure 6B:
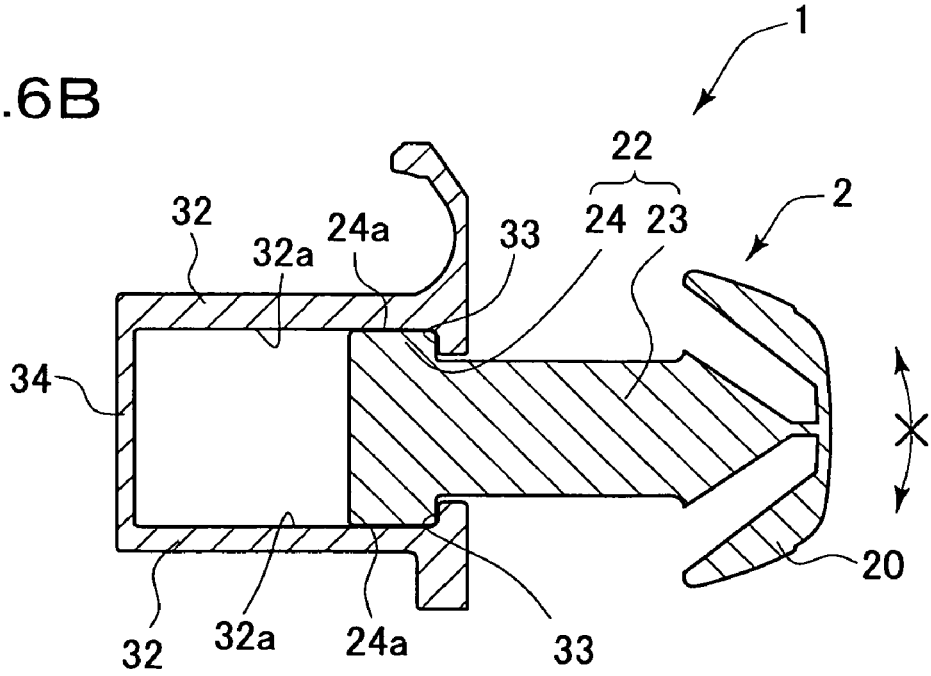
Figure 7A:
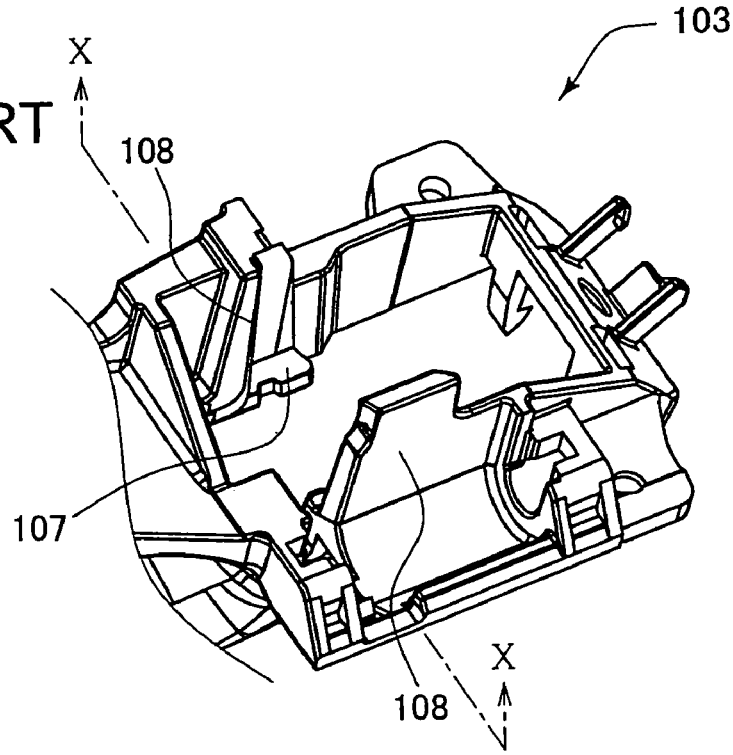
FIG.7A PRIOR ART
FIGS. 7A and 7B are an enlarged perspective view of important parts of a base member of a conventional vehicle door handle and a cross-sectional view of the base member taken along a line x-x of FIG. 7B, respectively.
Figure 7B:
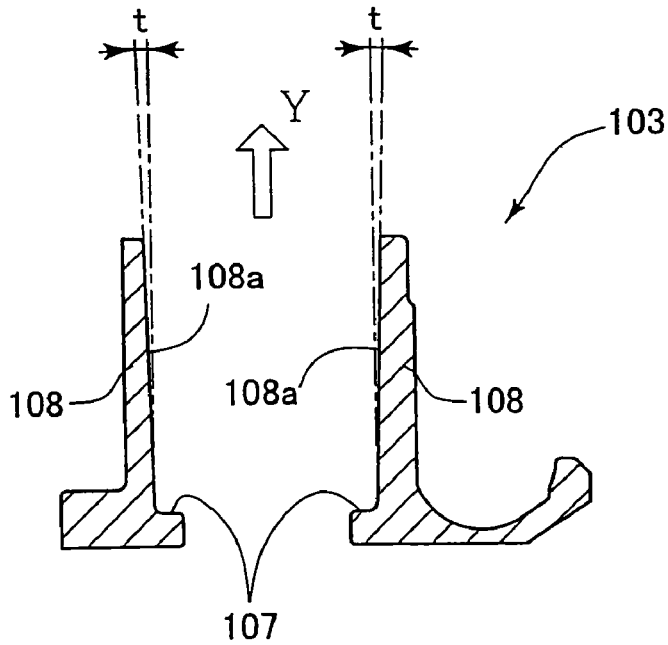
FIG.7B PRIOR ART
Figure 8A:
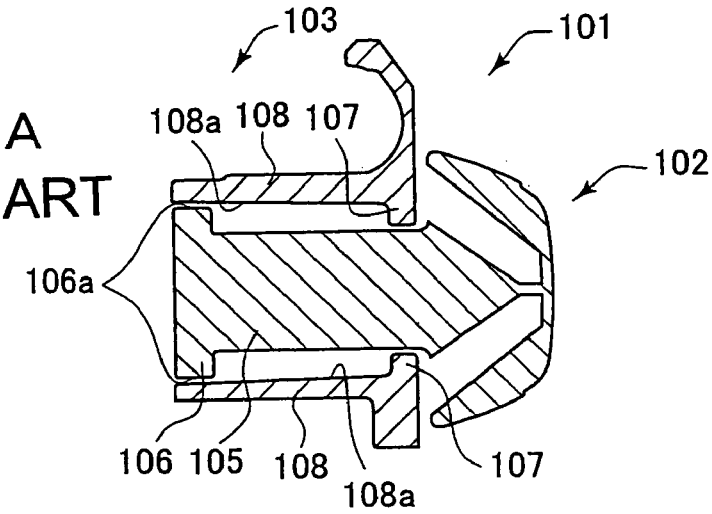
FIG.8A PRIOR ART
FIGS. 8A to 8C are explanatory views of states in which the conventional vehicle door handle is used, respectively.
Figure 8B:
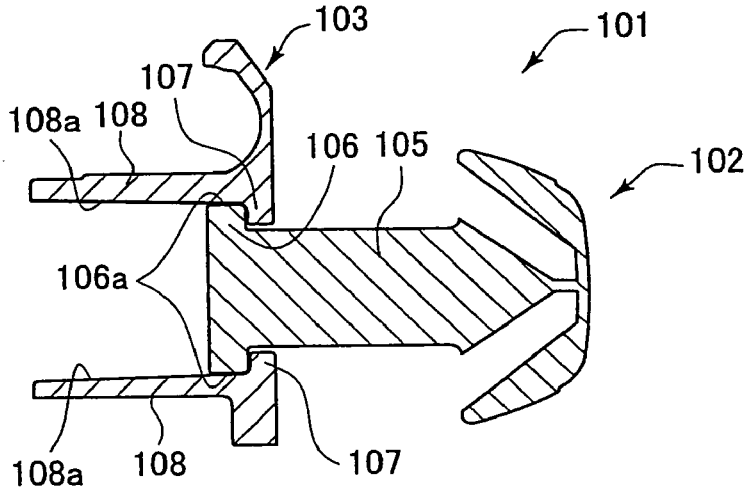
FIG.8B PRIOR ART
Figure 8C:
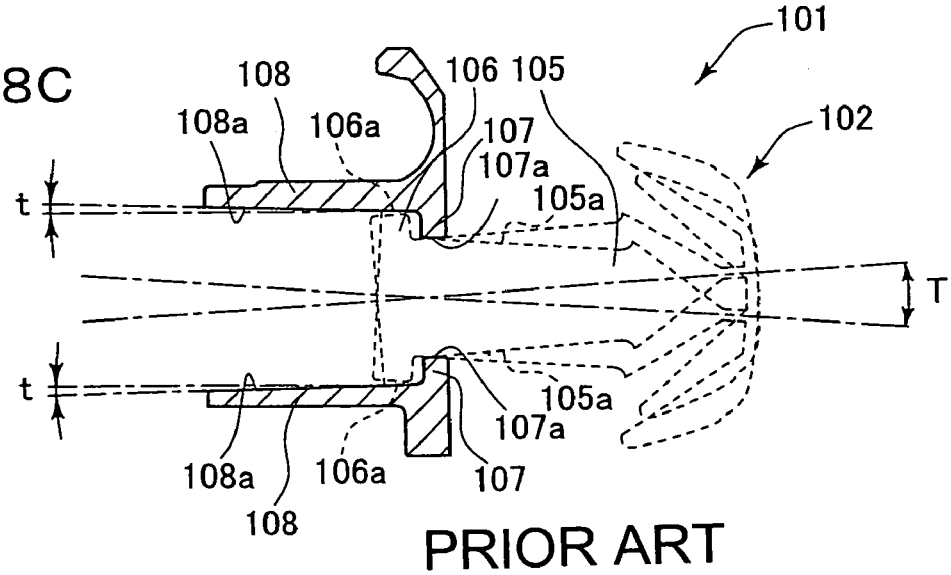

A part of states in which the vehicle door handle 1 is used will next be described. FIGS. 6A and 6B are explanatory views of the states of using the vehicle door handle 1, respectively. Specifically, FIG. 6A shows a state in which the handle main body 2 is not operated (located at the non-operated position). FIG. 6B shows a state in which the handle main body 2 is operated (located at the operated position). As shown in FIG. 6A, the handle main body 2 is always urged and held by the elastic member 4 in the direction of approaching the vehicle door. At this moment, the inner wall surfaces 32*a* of the respective guide walls 32 and the both side surfaces 24*a* of the stopper 24 are held while slidably abutting one another. Therefore, even if a user grips the handle main body 2 and applies a vertical force thereto, it is possible to suppress occurrence of the rattle.

As shown in FIG. 6B, if the handle main body 2 is pulled toward the position at which the stopper 24 is engaged with each stopper engagement portion 33 against the urging force of the elastic member 4, the door lock mechanism of the vehicle door is released. In the released state, if the handle main body 2 is further pulled toward the user, the vehicle door can be opened. At this time, no rattle occurs to the handle main body 2 even if the handle main body 2 is operated to be pulled up to the maximum state (operated position) for the following reason. Since the distance between the restriction points is wide, the side surface 24*a* of the stopper 24 and the inner wall surface 32*a* of each guide wall 32 are held to slidably abut each other by a sufficiently large area despite their unstable states in the vertical direction. Accordingly, it is possible to suppress the rattle from occurring to the handle main body 2 even if the user grips the handle main body 2 and applies the force thereto in the vertical direction. Hence, it is possible to provide the vehicle door handle 1 having the excellent feel. "Slidable abutment" includes an inter-surface distance range equal to or smaller than 0.1 millimeters, and means that the side surface 24*a* of the stopper 24 is brought into contact with the inner wall surface 32*a* of each guide wall 32 while lubricating these surfaces using a lubricant such as a grease.

Examples of the plastic material for molding the vehicle door handle 1 may include polycarbonate resins, polybutylene terephthalate resins, nylon resins, and Noryl® resins. They may be used alone or in combination of two or more of different types.

What is claimed is:

1. A vehicle door handle comprising:

a lever-shaped handle main body arranged at a predetermined position of an exterior of a vehicle door, and operated when the door is opened or closed; and a base member for attaching the handle main body to the vehicle door, wherein the handle main body is supported by the base member to be rotatable in a predetermined range, the handle main body having one end serving as a spindle and the other end serving as a free end, a hook on the free end of the main handle body protruding toward the base member in a longitudinal direction of the handle main body a handle stopper formed on a tip end of the hook that abuts on the base member, which restricts a rotation range of the handle main body, thereby setting an operated position and a non-operated position of the handle main body, the handle stopper having a sufficient thickness that prevents rattle of the handle main body in a direction away from the predetermined rotational range, and an insertion hole that the handle hook and the handle stopper are inserted into, a pair of guide walls adjacent to both side surfaces of the handle stopper, respectively, at the non-operated position of the handle main body, protruding from opening edges of the insertion holes, and having inner surfaces facing each other approximately parallel to each other, and a stopper engagement portion formed on the base member capable of locking the handle main body at the operated position when the handle is rotated from the base member, so as not to allow any further rotation, a connection portion formed integrally with the pair of guide walls, connecting each wall at a position where it is entirely not in contact with the tip end of the handle stopper when the handle main body is in the non operated position, wherein the pair of guide walls is arranged to face each side of the handle hook and each side of the handle stopper, and wherein the stopper engagement portion, the pair of guide walls and the connecting portion will reduce rattle that occurs when the handle main body is moved between the operated and non-operated position and ensure stability of the handle through the movement of it between the operated and non-operated position.

2. The vehicle door handle according to claim 1, wherein if the thickness of the stopper adjacent to the guide walls is d and a length of the hook is D, d/D falls within a range represented by $d/D \geqq 0.14$.

3. The vehicle door handle according to claim 1, wherein the pair of the guide walls are formed with no draft on inner wall surfaces of the guide walls.

4. The vehicle door handle according to claim 3, wherein if the thickness of the stopper adjacent to the guide walls is d and a length of the hook is D, d/D falls within a range represented by $d/D \geqq 0.14$.

5. The vehicle door handle according to claim 3, wherein the connection portion has a rectangular cross section having a flat surface opposed to an apical surface of the stopper and the flat surface is approximately parallel to the apical surface.

6. The vehicle door handle according to claim 5, wherein if the thickness of the stopper adjacent to the guide walls is d and a length of the hook is D, d/D falls within a range represented by $d/D \geqq 0.14$.

7. The vehicle door handle according to claim 1, wherein the connection portion has a flat surface opposed to and approximately parallel to the stopper.

8. The vehicle door handle according to claim 7, wherein if the thickness of the stopper adjacent to the guide walls is d and a length of the hook is D, d/D falls within a range represented by $d/D \geqq 0.14$.

* * * * *